US006515266B2

(12) United States Patent
Nasu et al.

(10) Patent No.: US 6,515,266 B2
(45) Date of Patent: Feb. 4, 2003

(54) COOKING APPARATUS

(75) Inventors: Tadashi Nasu, Izumisano (JP); Tadanobu Kimura, Hirakata (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/767,949

(22) Filed: Jan. 24, 2001

(65) Prior Publication Data

US 2001/0009256 A1 Jul. 26, 2001

(30) Foreign Application Priority Data

Jan. 24, 2000 (JP) ..... 2000-017910
Aug. 1, 2000 (JP) ..... 2000-232579

(51) Int. Cl.[7] ..... H05B 6/76
(52) U.S. Cl. ..... 219/739; 219/756
(58) Field of Search ..... 219/739, 756, 219/740, 741, 735, 757, 704, 723, 506, 702, 412, 413, 414, 391; 200/5 A, 262, 241

(56) References Cited

U.S. PATENT DOCUMENTS 4,010,343 A * 3/1977 Tanaka et al. ..... 219/740
4,255,640 A * 3/1981 Bressler ..... 219/704
4,982,063 A * 1/1991 Tsunekawa et al. ..... 219/723
6,018,153 A * 1/2000 Matsuda et al. ..... 219/506
6,057,534 A * 5/2000 Lee ..... 219/739

FOREIGN PATENT DOCUMENTS

| | | |
|---|---|---|
| JP | 58-23 | 1/1983 |
| JP | 1-189422 | 7/1989 |
| JP | 11-304161 | 11/1999 |

* cited by examiner

*Primary Examiner*—Teresa Walberg
*Assistant Examiner*—Quang Van
(74) *Attorney, Agent, or Firm*—Birch, Stewart, Kolasch & Birch, LLP

(57) ABSTRACT

A cooking apparatus has a door for opening and closing the opening of a heating chamber. The door has an operation portion that permits setting of heating conditions such as heating time and heating mode and a display panel for displaying the heating conditions. The door is composed of a door frame constituting the outer frame of the door, and a door screen made of an elastic material and fitted in the door frame. A door sheet is laid over the door screen by being bonded thereto. In the door sheet are formed operation keys that are arranged in the operation portion, a transparent portion that serves as a display window through which to view the display panel, and a transparent portion that serves as a peep window through which to look into the heating chamber.

12 Claims, 13 Drawing Sheets

COOKING APPARATUS

BACKGROUND OF THE INVENTION

1. Field of the Invention

The present invention relates to a cooking apparatus, such as a microwave oven, having a heating chamber that is closed with a door provided with an operation portion that permits setting of heating conditions such as heating time and heating mode, a display portion that permits display of the heating conditions set through operation of the operation portion, and a peep window that permits observation of the inside of the heating chamber.

2. Description of the Prior Art

As an example of a conventional cooking apparatus, Japanese Patent Application Laid-Open No. S58-23 discloses a microwave oven. This microwave oven is provided with a door for opening and closing the opening at the front of a heating chamber. The door is fitted with various electronic components such as operation keys, a display panel, and printed circuit boards. The operation keys are provided in an operation portion that permits setting of heating conditions such as heating time and heating mode. The display panel displays the heating conditions set through operation of the operation portion.

However, this conventional microwave oven is so constructed that the operation keys of the operation portion, the display window of the display panel, the peep window through which to look into the heating chamber, and other components are prepared separately and are then assembled together. That is, the conventional microwave oven requires a large number of components, and thus requires unduly high cost.

On the other hand, as another example of a conventional cooking apparatus, Japanese Patent Application Laid-Open No. H1-189422 discloses a microwave oven as shown in FIG. 15. At the front of a body 165 of the microwave oven, a door 163 is pivoted on hinges 168. The door 163 is provided with an operation portion 161 having operation keys and a display portion 162. The operation portion 161 and the display portion 162 are connected by way of leads 164 to a power supply portion 166 provided inside the body 165.

The hinges 168 are fitted with a lead cover 167 for covering the leads 164, and is fixed to the body 165. The leads 164 are so laid as to run first inside the door 163, then out of the door 163 through the bottom face thereof, and then into and through the lead cover 167 so as to be led into the body 165 through the front face thereof. In this way, the lead cover 167 covering the leads 164 helps prevent the leads 164 from being exposed and thereby protect them from damage when the door 163 is opened or closed.

As another example, Japanese Patent Application Laid-Open No. H11-304161 discloses a microwave oven as shown in FIG. 16. In a body 171 of this microwave oven, above a door 172 is provided a vent that communicates with the inside of a heating chamber in which to put an article to be heated. Here, to keep up acceptable appearance of the front face of the body 171, a louver 173 is fitted so as to cover the vent.

However, the conventional microwave ovens described above require an extra component, such as the lead cover 167 (see FIG. 15) or the louver 173 (see FIG. 16), to protect leads or to keep up acceptable appearance. This, inconveniently, increases the total number of components required, and thus leads to accordingly lower productivity and higher cost.

SUMMARY OF THE INVENTION

An object of the present invention is to provide a cooking apparatus that permits operation keys, a display window, and a heating chamber peep window to be formed in a door easily and thus at lower cost.

Another object of the present invention is to provide a cooking apparatus that permits protection of leads without an increase in the total number of components required.

Still another object of the present invention is to provide a cooking apparatus that offers acceptable appearance without an increase in the total number of components required.

To achieve the above objects, according to one aspect of the present invention, a cooking apparatus is provided with: a body having a heating chamber in which to put an article to be heated; a door for opening and closing the opening of the heating chamber; an operation portion, provided on the door, that permits control of cooking operation; a display panel, provided on the door, for displaying information; a door screen fitted in the front face of the door and formed of a transparent member; and a door sheet laid over the door screen by being bonded thereto.

Here, in the door sheet are formed operation keys that permits entry of the heating conditions into the operation portion, a transparent portion that serves as a display window through which to view the display panel, and a transparent portion that serves as a peep window through which to look into the heating chamber.

In this construction, the operation keys, the display window, and the peep window can easily be formed in the door face simply by fitting the door screen in the outer frame of the door.

According to another aspect of the present invention, a cooking apparatus is provided with: a body having a heating chamber in which to put an article to be heated; a door for opening and closing the opening of the heating chamber; a support member shaped like a frame so as to cover a bottom portion of the front face of the body below the door and simultaneously support the body; electronic components fitted on the door; a power supply portion provided inside the body so as to supply electric power to the electronic components; and leads for connecting the electronic components to the power supply portion.

Here, the inside of the door communicates with the inside of the support member through a first opening formed in the top face of the support member facing the bottom face of the door and through a second opening formed in the bottom face of the door, and the inside of the support member communicates with the inside of the body through a third opening formed in the front face of the body below the door. Moreover, the leads are so laid as to run first inside the door then inside the support member and then reach into the body.

In this construction, the leads that have left the door then run inside the support member and then reach into the body. Thus, no part of the leads is exposed.

In this construction, by providing a vent in the front face of the body below the door, and forming an opening communicating with the vent in a portion of the support member covering the front face of the body, it is possible to permit the inside of the body to communicate with the outside through the vent provided in the front face of the body and through the communicating opening formed in the support member. This permits outside air to be introduced into the body through the communicating opening and the vent.

According to another aspect of the present invention, a cooking apparatus is provided with: a body having a heating chamber in which to put an article to be heated; a door for opening and closing the opening of the heating chamber; a heating element provided below the heating chamber; and a frame-shaped member provided below the door so as to cover the front side of the heating element and having a vent formed therein.

In this construction, outside air is introduced into the body through the vent formed in the frame-shaped member to cool the heating element provided below the heating chamber.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

First Embodiment

Figure 1:
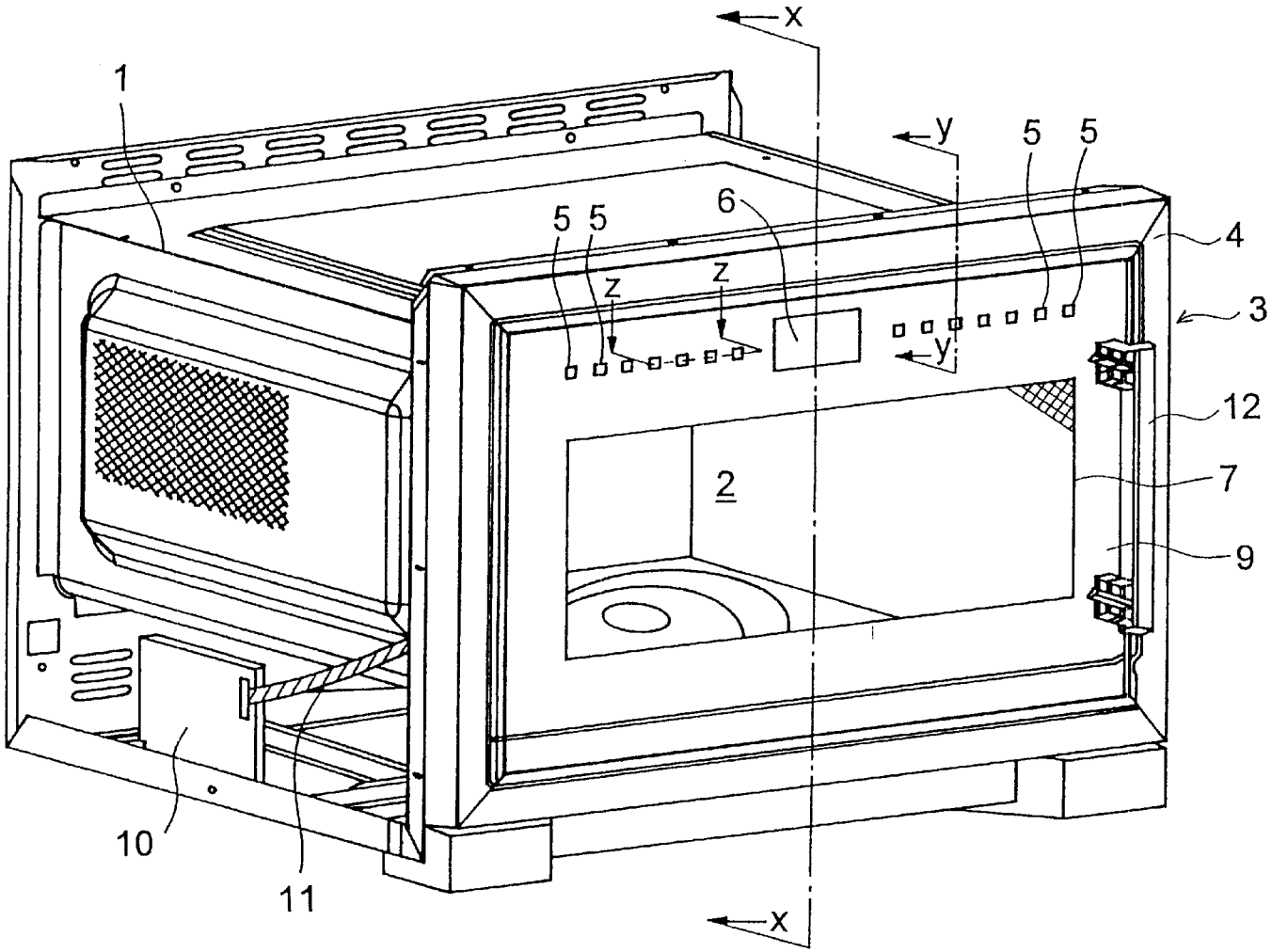
FIG. 1 is a perspective external view of the cooking apparatus of a first embodiment of the invention.

A first embodiment of the invention will be described below with reference to the drawings. FIG. 1 is a perspective external view of the cooking apparatus of this embodiment. In FIG. 1, reference numeral 3 represents a door for opening and closing the opening formed at the front of a heating chamber 2 formed inside a body 1. Reference numeral 4 represents a door frame that constitutes the outer frame of the door 3 and that serves to seal the heating chamber 2 to insulate it from the outside. Reference numerals 5, 6, and 7 represent operation keys, a display window, and a peep window, respectively, that are formed, by printing or the like, in a door sheet 9 (described later) that is laid over a door screen 8 (described later, see FIG. 2) by being bonded thereto.

The door 3 has various electronic components fitted there on, which are connected by way of leads 11 to a power supply portion 10 provided inside the body 1. Moreover, the door 3 is, at one end in the width direction thereof, fitted with a handle 12, and is, at the other end, fitted with a hinge mechanism (not shown) that rotatably supports the door 3. When an article to be heated is put in or taken out of the heating chamber 2, the door 3 is opened and closed by being rotated on the hinge mechanism with the handle 12 held with a hand.

Figure 2:
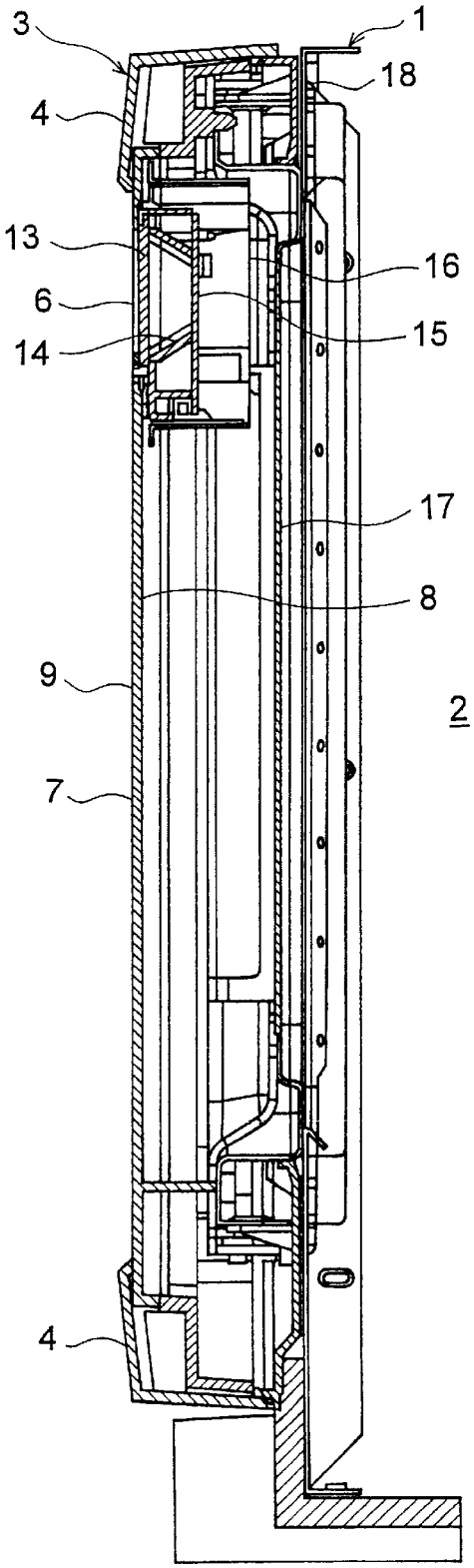
FIG. 2 is a sectional view taken along line x—x shown in FIG. 1.

FIG. 2 is a sectional view taken along line x—x shown in FIG. 1. As shown in FIG. 2, a door screen 8 is fitted in the door frame 4, and a door sheet 9 is laid over the outer surface of the door screen 8 by being bonded thereto. The door sheet 9 is bonded to the door screen 8 by insertion molding. Specifically, first the door sheet 9 is put in a mold, then, as a material of the door screen 8, a light-transmitting, elastic resin is poured over the door sheet 9, and then the resin is hardened so that the two are bonded together.

Reference numeral 13 represents a display panel such as a liquid crystal display panel. The display panel 13 is fixed to a printed circuit board 15 by a liquid crystal display panel holder 14 in a position where what is displayed on the display panel 13 can be viewed through the display window 6 that is formed by making a portion of the door sheet 9 transparent. On the printed circuit board 15 are provided a control circuit (not shown) and tactile switches (not shown, but described later). The control circuit, on the one hand, displays on the display panel 13 the heating conditions such as heating time and heating mode set through operation of the operation keys 5, and, on the other hand, controls a high-frequency generator (not shown) that generates microwaves by which to cook an article to be heated (not shown) that is put in the heating chamber 2.

Reference numeral 16 represents a cup-shaped metal cover (described later). Reference numeral 17 represents a door panel that constitutes the back face of the door 3. The door panel 17 has many small holes formed therein in a portion thereof that corresponds to the peep window 7 that is formed by making a portion of the door sheet 9 transparent. This makes it possible to look into the heating chamber 2 through the peep window 7. Reference numeral 18 represents a choke cover that shuts off electromagnetic waves.

Figure 3:
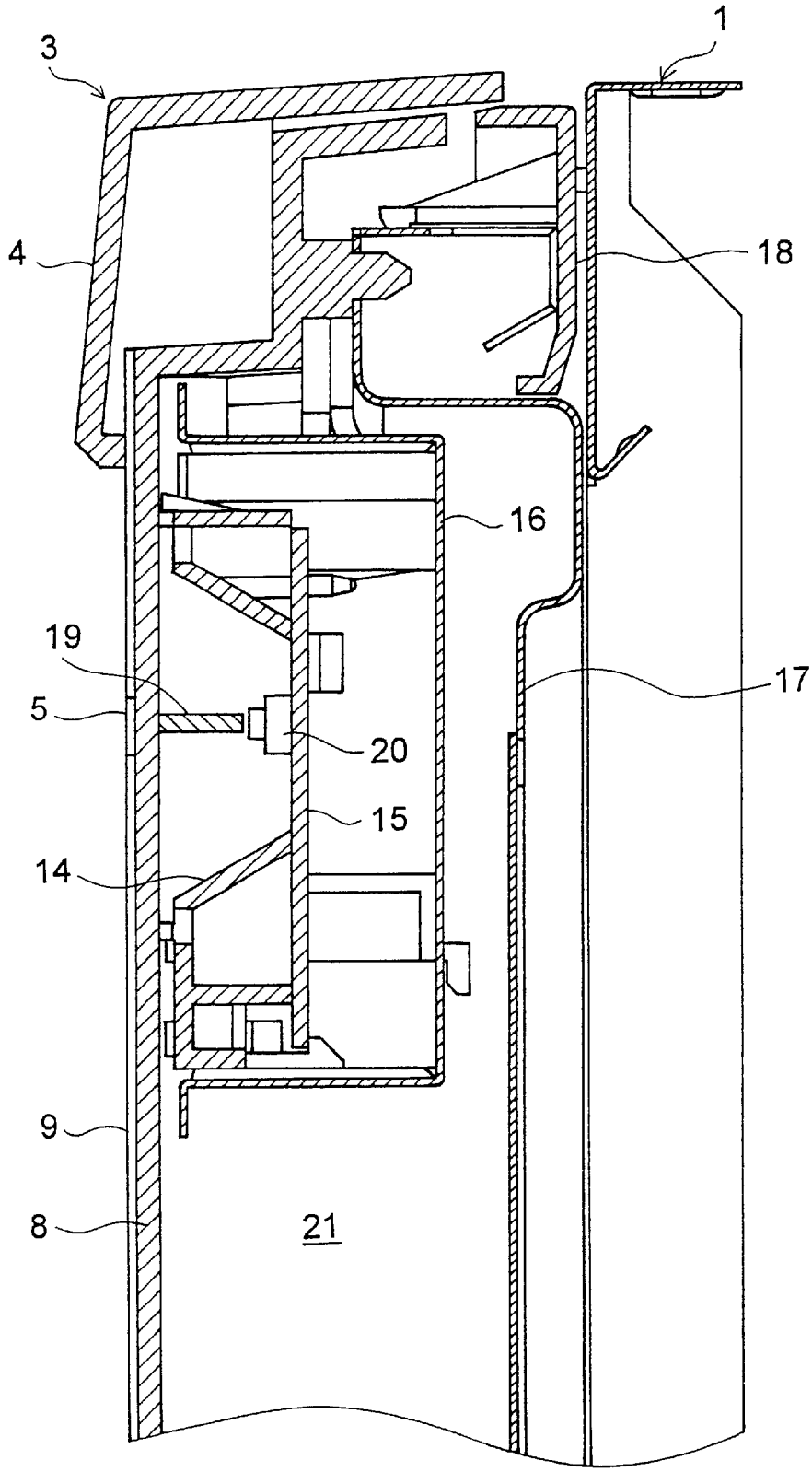
FIG. 3 is a partial sectional view of the door of the cooking apparatus of the first embodiment, taken along a line corresponding to line y—y shown in FIG. 1.

FIG. 3 is a partial sectional view of the door of the cooking apparatus of this embodiment, taken along a line corresponding to line y—y shown in FIG. 1. As shown in FIG. 3, the operation portion of the cooking apparatus of this embodiment includes, for each of the operation keys 5, a rib 19 that projects inward from the back face of the door screen 8, and a tactile switch 20 that is driven to make or break contact by the rib 19 as the operation key 5 is operated.

When the operation key 5 is not being operated, there is a predetermined gap left between the tip of the rib 19 and the tactile switch 20, so that the tact switch 20 is kept off without making contact. When the operation key 5 is pressed, the rib 19 sinks further into the door 3, and presses the tactile switch 20, so that the tactile switch 20 makes contact and is thus turned on. When the operation key 5 is released from the pressure applied thereto, the resilience of the door screen 8 moves the rib 19 back to its original position, so that the tactile switch 20 breaks contact and is thus turned off.

The tactile switch 20 need not be provided on the printed circuit board 15; that is, it may be provided anywhere else, for example by being fixed on a plate-shaped member provided separately from the printed circuit board 15, as long as it can function as a switch.

In this cooking apparatus constructed as described above, when the door 3 is closed with an article to be heated put in the heating chamber 2 and then one among the operation keys 5 is selected and pressed, the corresponding rib 19 sinks inward and its tip presses the tact switch 20. This causes the tact switch 20 to make contact, and the resulting signal is fed to the control circuit provided on the printed circuit board 15. On the basis of this signal, the control circuit displays the heating conditions such as heating time and heating mode on the display panel 13 (see FIG. 2) and also activates the high-frequency generator (not shown) to start cooking the article to be heated that is put in the heating chamber 2.

The electronic components such as the tact switches 20, the display panel 13 (see FIG. 2), and the print circuit board 15 are arranged in the space 21 between the door screen 8 and the door panel 17. Since, as described above, the door panel 17 has many small holes formed therein, while the cooking apparatus is in heating operation, microwaves used for heating and steam evaporating from the article to be heated, such as food, are likely to enter the space 21 through those small holes. This may lead to malfunctioning or failure of the above-mentioned electronic components.

To prevent this, as shown in the figure, those electronic components are covered with a metal cover 16 extending in the width direction of the door 3 and having a C-shaped cross section. This cover 16 shuts out microwaves and steam, and thereby prevents their- adverse effects on the electronic components.

Second Embodiment

Figure 4:
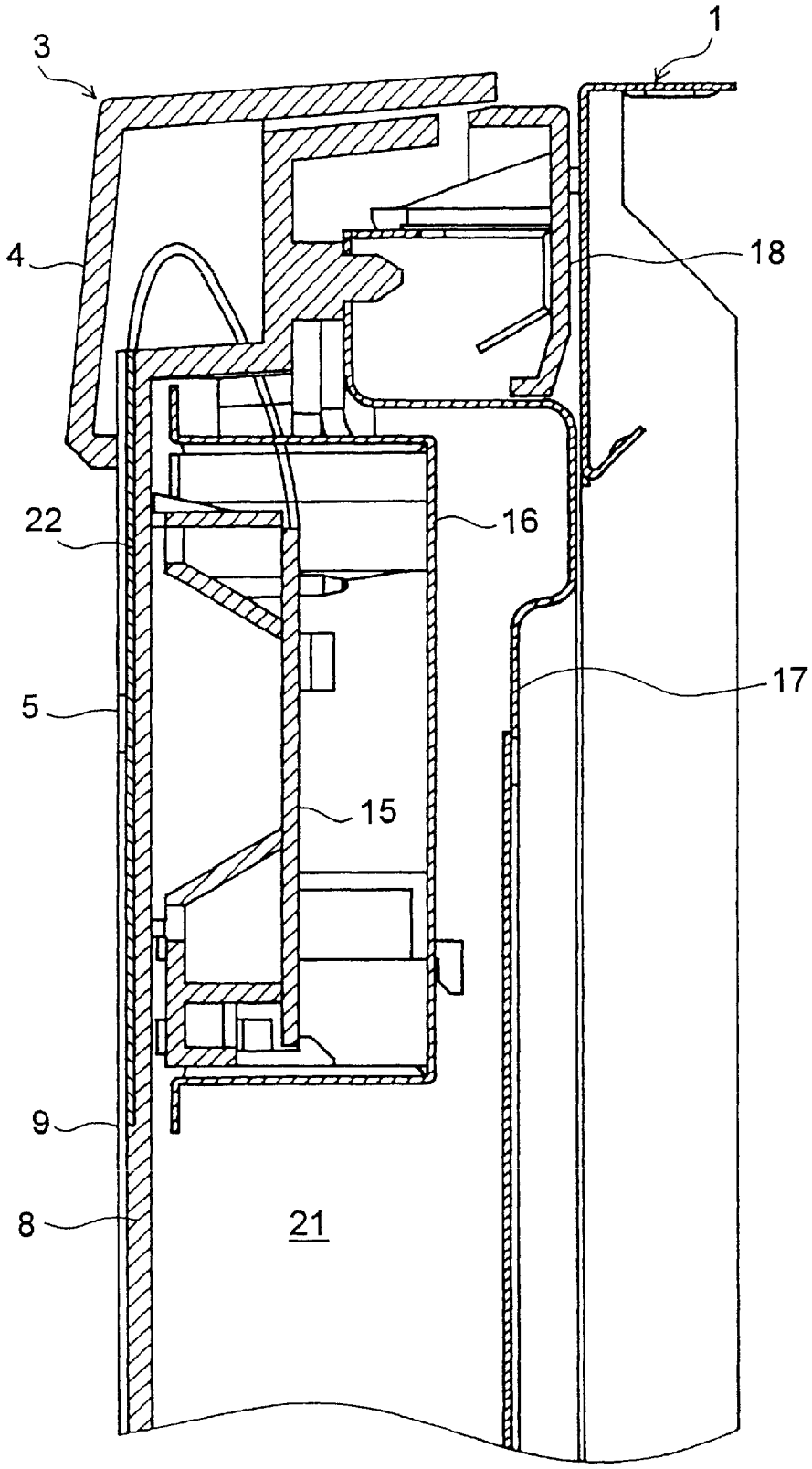
FIG. 4 is a partial sectional view of the door of the cooking apparatus of a second embodiment of the invention, taken along a line corresponding to line y—y shown in FIG. 1.
Figure 5:
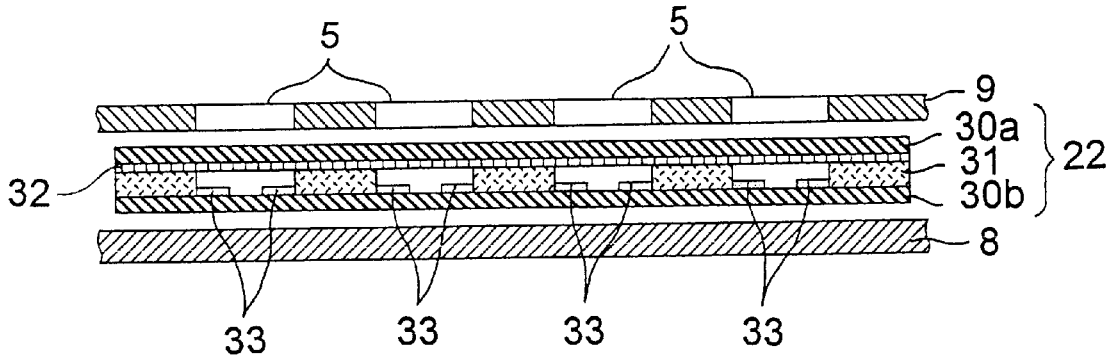
FIG. 5 is a partial sectional view of the cooking apparatus of the second embodiment, taken along a line corresponding to line z—z shown in FIG. 1.
Figure 6:
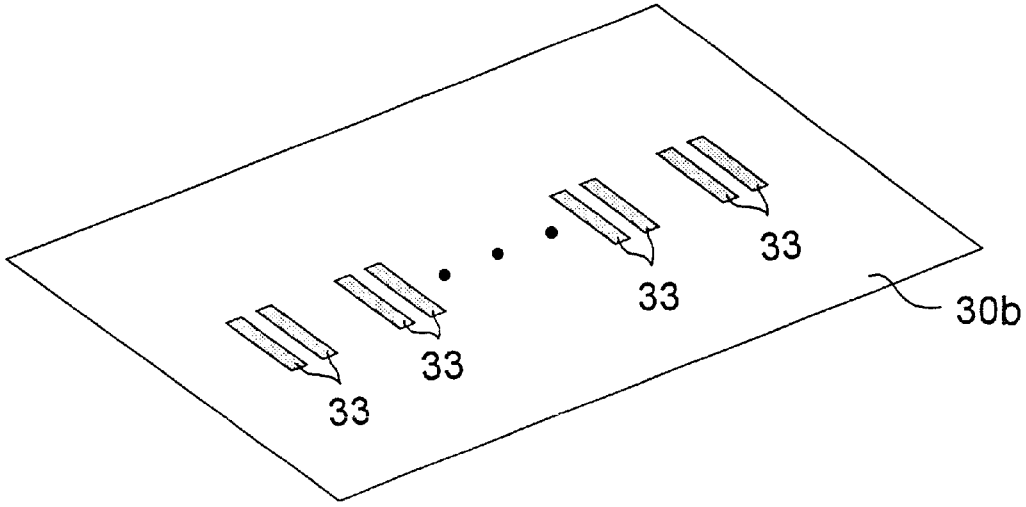
FIG. 6 is a perspective view of the pattern sheet constituting a part of the printed electrode assembly.

A second embodiment of the invention will be described below with reference to the drawings. FIG. 4 is a partial sectional view of the door of the cooking apparatus of this embodiment, taken along a line corresponding to line y—y shown in FIG. 1. FIG. 5 is a partial sectional view of the cooking apparatus of this embodiment, taken along a line corresponding to line z—z shown in FIG. 1. FIG. 6 is a perspective view of the pattern sheet that constitutes a part of the printed electrode assembly used in this embodiment. In these figures, such members as are found also in the first embodiment described previously are identified with the same reference numerals, and their detailed explanations will not be repeated.

As shown in FIG. 4, the operation portion of the cooking apparatus of this embodiment includes a printed electrode assembly 22 sandwiched between the door screen 8 and the door sheet 9. As shown in FIG. 5, this printed electrode assembly 22 is composed of an electrode sheet 30*a* having its back surface coated with a conductive thin film 32 made of, for example, carbon, a pattern sheet 30*b* having switch contacts 33 (see FIG. 6) arranged on its front surface one pair for each of the operation keys 5, and a spacer 31 sandwiched between the electrode sheet 30*a* and the pattern sheet 30*b* so as to avoid the switch contacts 33 and made of an insulating material such as PET (polyethylene terephthalate). To these switch contacts 33 arranged on the pattern sheet 30*b*, electric wires are connected individually that are, at the other end, bundled and connected to the control circuit provided on the printed circuit board 15.

In this cooking apparatus constructed as described above, when the door 3 is closed with an article to be heated put in the heating chamber 2 and then one among the operation keys 5 is selected and pressed, the corresponding pair of switch contacts 33 on the pattern sheet 30*b* of the printed electrode assembly 22 make contact, and the resulting signal is fed to the control circuit provided on the printed circuit board 15. On the basis of this signal, the control circuit displays the heating conditions such as heating time and heating mode on the display panel 13 (see FIG. 2) and also activates the high-frequency generator (not shown) to start cooking the article to be heated that is put in the heating chamber 2.

The electronic components such as the printed electrode assembly 22, he display panel 13 (see FIG. 2), and the print circuit board 15 are arranged in the space 21 between the door screen 8 and the door panel 17. Since, as described previously, the door panel 17 has many small holes formed therein, while the cooking apparatus is in heating operation, microwaves used for heating and steam evaporating from the article to be heated, such as food, are likely to enter the space 21 through those small holes. This may lead to malfunctioning or failure of the above-mentioned electronic components.

To prevent this, as shown in the figure, those electronic components are covered with a metal cover 16 extending in the width direction of the door 3 and having a C-shaped cross section. This cover 16 shuts out microwaves and steam, and thereby prevents their adverse effects on the electronic components.

Third Embodiment

Figure 7:
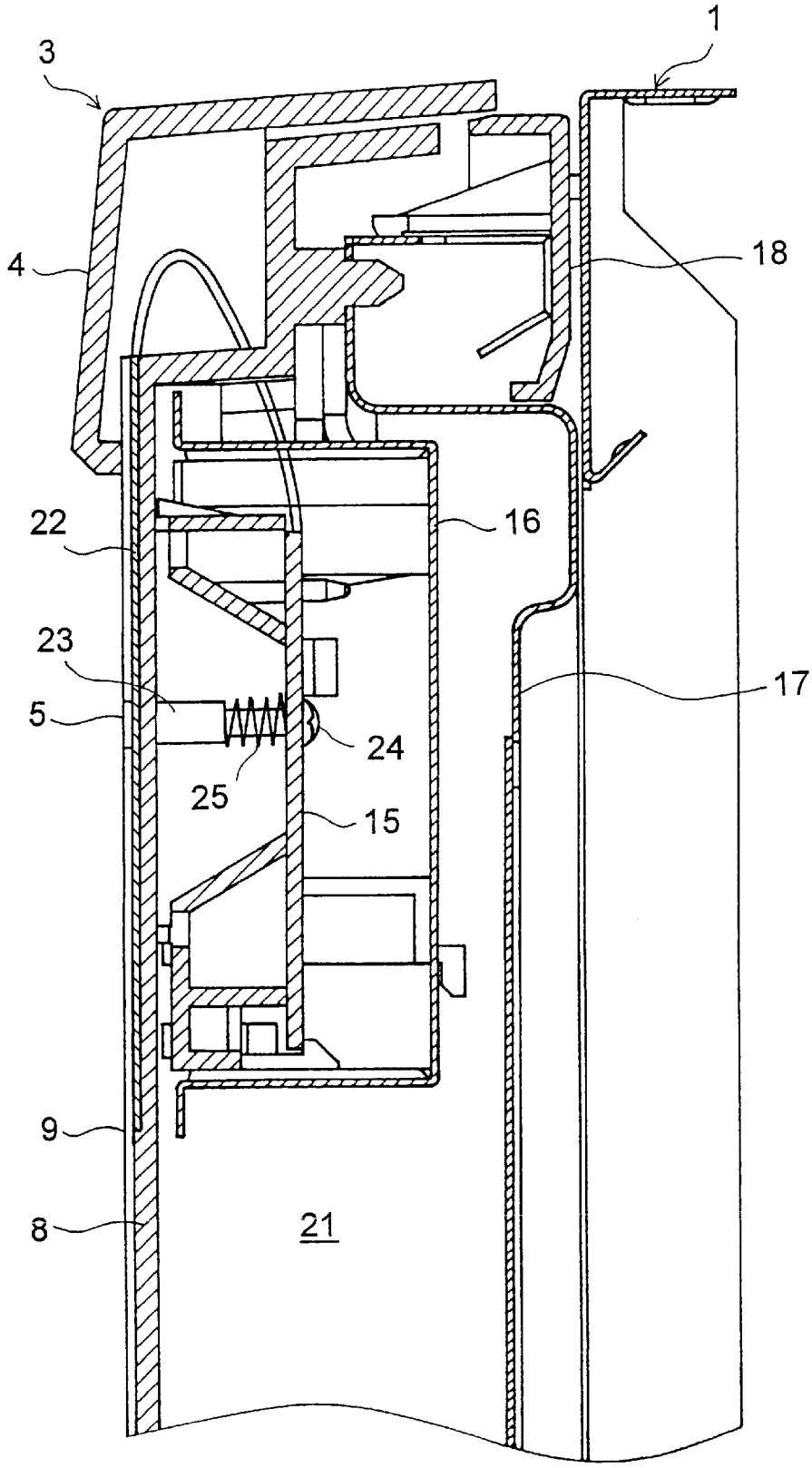
FIG. 7 is a partial sectional view of the door of the cooking apparatus of a third embodiment of the invention, taken along a line corresponding to line y—y shown in FIG. 1.

A third embodiment of the invention will be described below with reference to the drawings. FIG. 7 is a partial sectional view of the door of the cooking apparatus of this embodiment, taken along a line corresponding to line y—y shown in FIG. 1. In FIG. 7, such members as are found also in the previously described embodiments are identified with the same reference numerals, and their detailed explanations will not be repeated.

When an article to be heated is put in or taken out of the heating chamber 2 (see FIG. 1) of the cooking apparatus, the door 3 is opened and closed. On such occasions, the strong shock accompanying the opening or closing of the door 3 is transmitted to the printed circuit board 15 provided inside the door 3. The printed circuit board 15 itself is not very resistant to a shock, and therefore subjecting it to a strong shock may result in damage to the board 15 or breakage in the circuit pattern formed in the surface of the board 15.

To prevent this, in this embodiment, a cylindrical screw base 23 that projects from the back face of the door screen 8 is provided, and a screw 24 is put through a round through hole (not shown) formed in the printed circuit board 15 and then through a spring 25, and is then screwed tight into the screw base 23.

This permits the printed circuit board 15 to be fixed to the door screen 8 in such a way that the printed circuit board 15 can vibrate back and forth together with the spring 25 along the screw 24. Thus, the spring 25 absorbs the shock accompanying the opening or closing of the door 3, making the vibration of the printed circuit board 15 weaker and weaker. This helps alleviate the shock transmitted to the printed circuit board 15 and thereby prevent damage thereto or the like mentioned above.

The embodiments described hereinbefore deal only with cases where, as shown in FIG. 1, the operation keys 5 and the display window 6 are formed above the peep window 7 that is formed substantially at the center of the door 3 in the width direction thereof. It is to be understood, however, that the arrangement of those members specifically described above is given merely as an example and is not intended to limit in any way their arrangement in practice.

Fourth Embodiment

Figure 8:
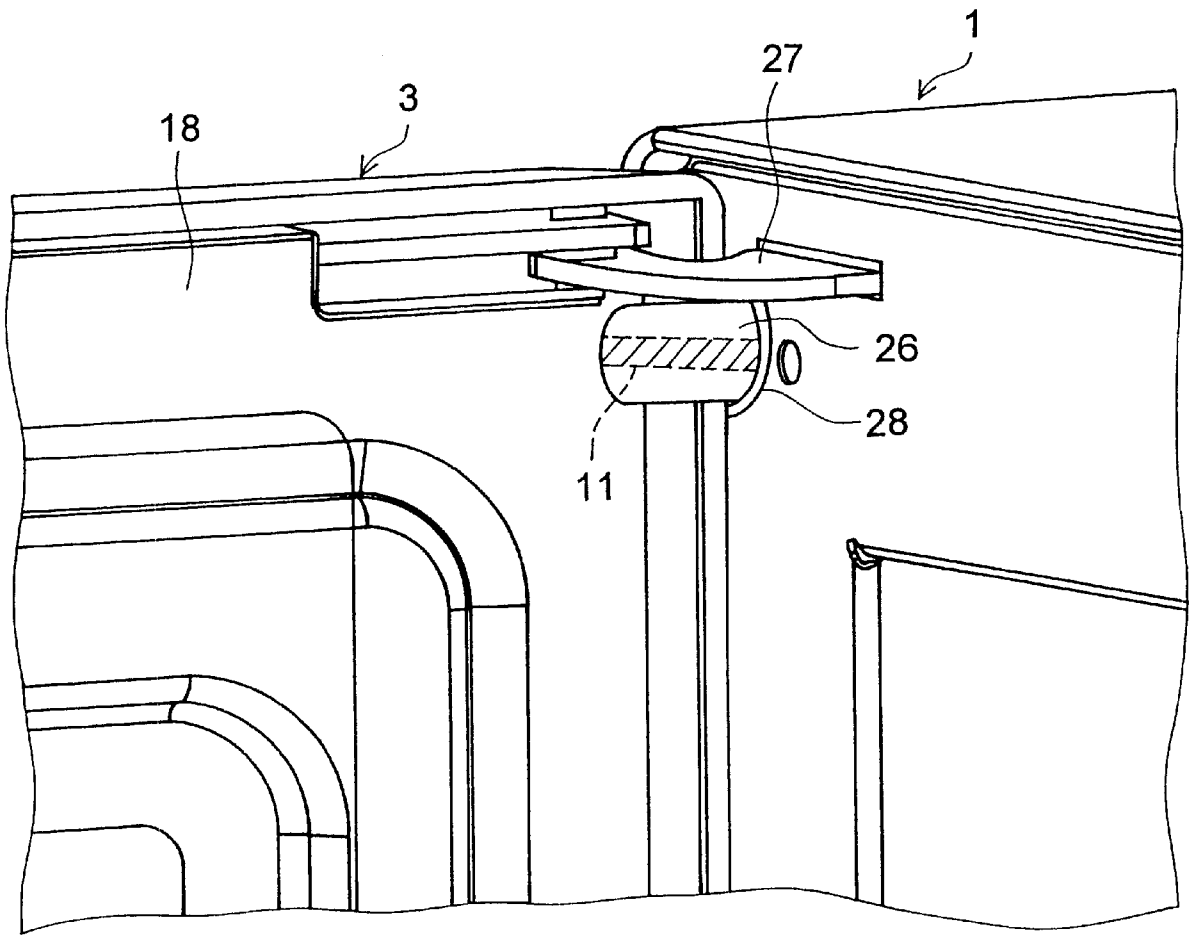
FIG. 8 is an enlarged perspective view of a portion around the rotation axis of the door of the cooking apparatus of a fourth embodiment of the invention, as observed when the door is open.

A fourth embodiment of the invention will be described below with reference to the drawings. FIG. 8 is an enlarged perspective view of a portion around the rotation axis of the door of the cooking apparatus of this embodiment, as observed when the door is open. In FIG. 8, such members as are found also in the previously described embodiments are identified with the same reference numerals, and their detailed explanations will not be repeated.

As shown in FIG. 1, the electronic components provided inside the door 3, such as the display panel 13 (see FIG. 2) and the printed circuit board (see FIG. 2), are connected by way of the leads 11 to the power supply portion 10 provided inside the body 1. If these leads 11 are so laid as to be exposed when the door 3 is opened and closed, the leads 11 so exposed spoil the appearance of the cooking apparatus and thus makes the product less attractive.

To prevent this, in this embodiment, as shown in FIG. 8, below an upper hinge 27 that is fixed, with screws or the like, near one edge of the front face of the body 1, a sleeve 26 that projects from inside the door 3 into the body 1 is provided, and the leads 11 are laid inside this sleeve 26 so as not to be exposed.

Figure 9A:
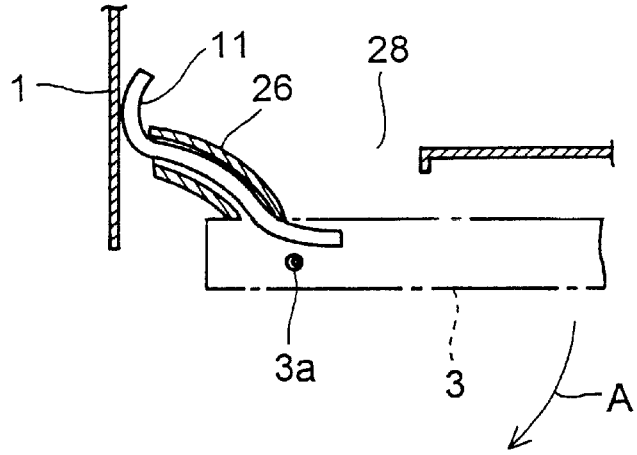
FIGS. 9A and 9B are horizontal sectional views of a portion around the sleeve provided on the door of the cooking apparatus of the fourth embodiment, as observed when the door is closed and opened, respectively.
Figure 9B:
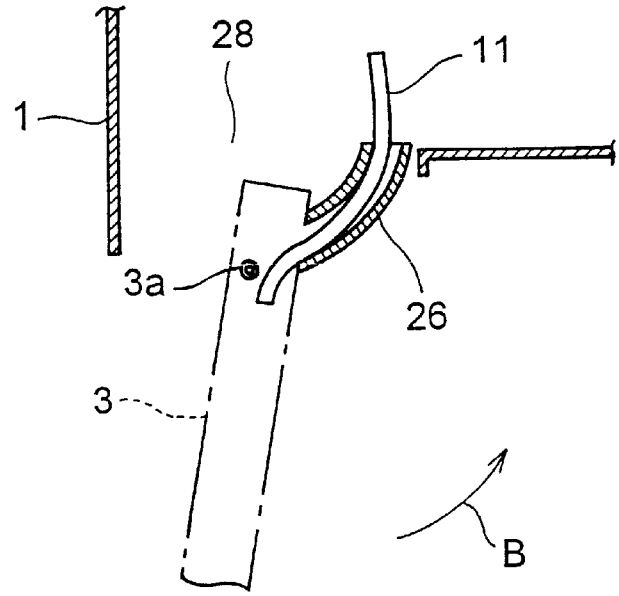

FIGS. 9A and 9B are horizontal sectional views of a portion around the sleeve of the cooking apparatus of this embodiment. When the door 3 is opened or closed, it rotates about a rotation axis 3*a* through about 90° to 110° between a closed position shown in FIG. 9A and an open position shown in FIG. 9B. The sleeve 26 is arc-shaped in its horizontal section. In the open position shown in FIG. 9B, the tip of the sleeve 26 is located somewhat inside the body 1 through an opening 28 formed there.

As the door 3 is closed by being rotated in the direction indicated by arrow B, the sleeve 26 rotates together and moves leftward in the opening 28. Meanwhile, the tip of the sleeve 26 goes farther into the body 1 away from the opening 28 so that the sleeve 26 never comes completely out of the body 1.

This makes it possible to prevent exposure of the leads 11 easily without hampering smooth opening and closing movement of the door 3. Furthermore, providing the sleeve 26 below the upper hinge 27 makes the sleeve 26 inconspicuous, and thus helps make the appearance of the cooking machine acceptable.

It is also possible to provide a similar sleeve 26 below a lower hinge (not shown) that has an identical shape with the upper hinge 27 and that constitutes together with the upper hinge 27 an opening/closing mechanism of the door 3, and lay the leads 11 through such a sleeve 26. This equally helps prevent exposure of the leads 11.

Fifth Embodiment

Figure 10:
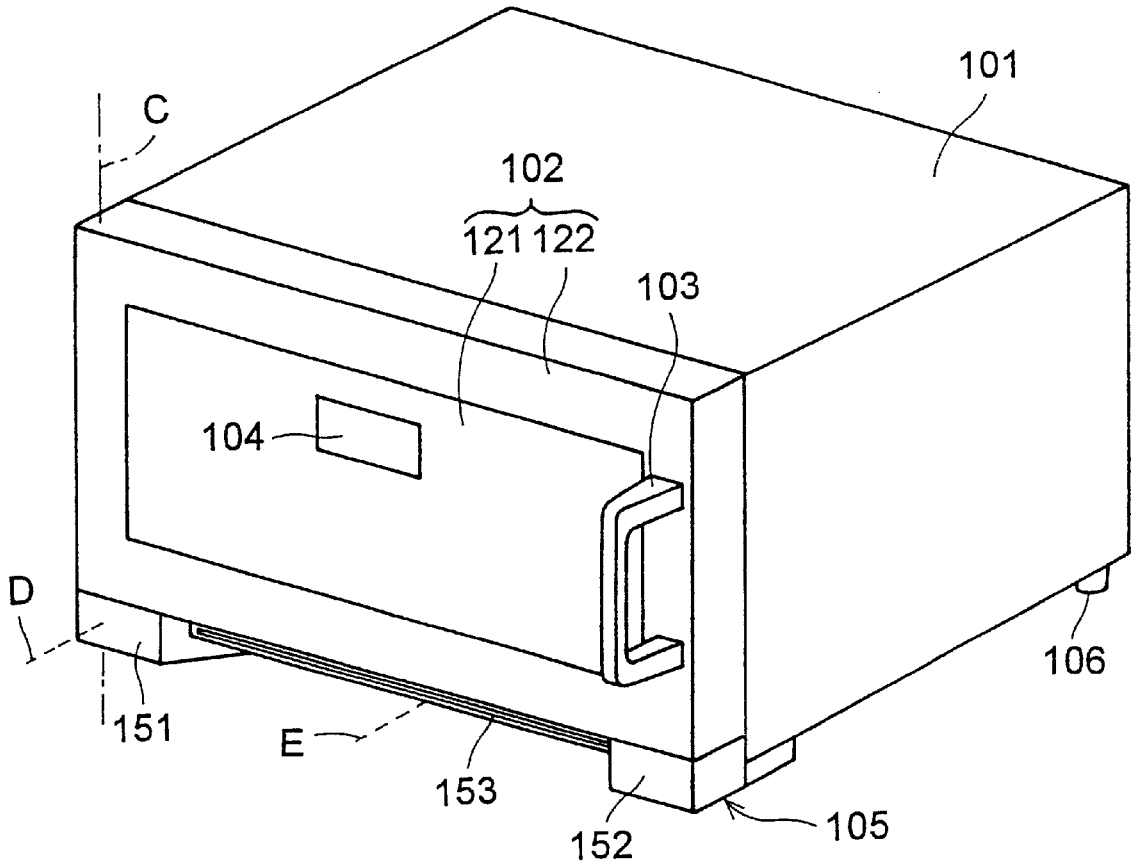
FIG. 10 is a perspective external view of an example of the cooking apparatus of a fifth embodiment of the invention.

A fifth embodiment of the invention will be described below with reference to the drawings. FIG. 10 is a perspective external view of the cooking apparatus of this embodiment. Reference numeral 101 represents a body having a heating chamber (not shown) formed inside. Reference numeral 102 represents a door fitted at the front of the body 101 to open and close the heating chamber. Reference numeral 103 represents a handle of the door 102. Reference numeral 104 represents electronic components, such as a control panel and a liquid crystal display, provided in an upper central portion of a door screen 121. The door 102 is opened and closed by being rotated in a horizontal plane about a rotation axis indicated by dash-and-dot line C.

Reference numeral 105 represents a support member for supporting the body 101 at a front bottom portion thereof. Reference numeral 106 represents support feet for supporting the body 101 at a rear bottom portion thereof. The support member 105 is placed directly on the installation surface, and is a frame-shaped member composed of a first and a second foot portion 151 and 152 that support the body 101 at its left-hand and right-hand ends, respectively, and an elongate front cover portion 153 that integrally join the first and second foot portions 151 and 152.

Figure 11A:
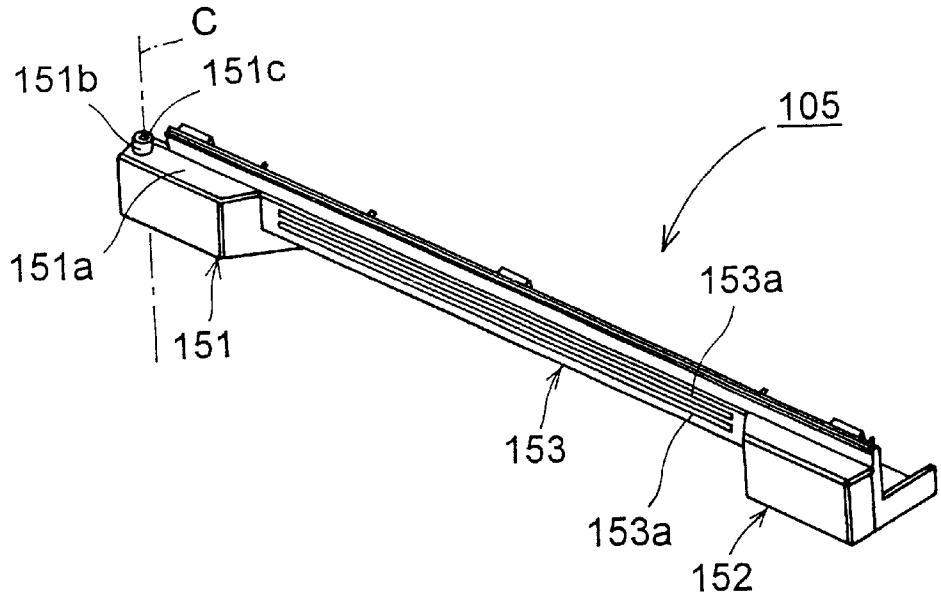
FIGS. 11A and 11B are perspective external views of two examples of the support member of the cooking apparatus of the fifth embodiment, the latter showing only a portion around the first opening in an enlarged view.

As shown in FIG. 11A, the first and second foot portions 151 and 152 each have a front face, a top face, a left and a right side face, and a bottom face that is kept in contact with the floor surface. On the top face 151*a* of the first foot portion 151, a first opening 151*c* is formed integrally with a cylindrical sleeve 151*b* that is formed around it so as to extend upward. The first opening 151*c* has its center on the rotation axis C of the door 102 (see FIG. 10).

Figure 11B:
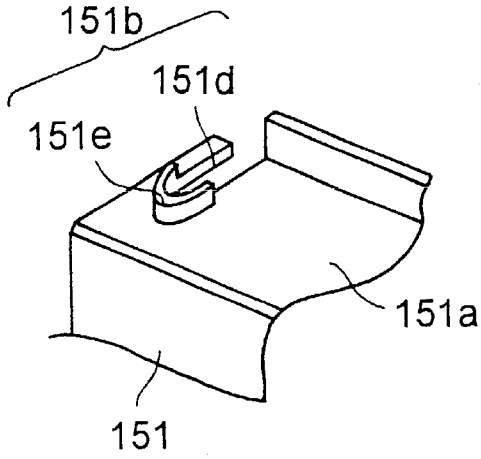

In the front face of the front cover portion 153, elongate communicating openings 153*a* are formed, and in addition louver boards (not shown, but described later) are provided. The sleeve 151*b* need not be cylindrically shaped, but may be, as shown in an enlarged view in FIG. 11B, so shaped as to have a slit portion 151*d* and a U-shaped portion 151*e*. This makes easier the wiring between the door 102 (see FIG. 10) and the body 101 (see FIG. 10) and the fitting of the first foot portion 151 to the body 101 (see FIG. 10).

Figure 12:
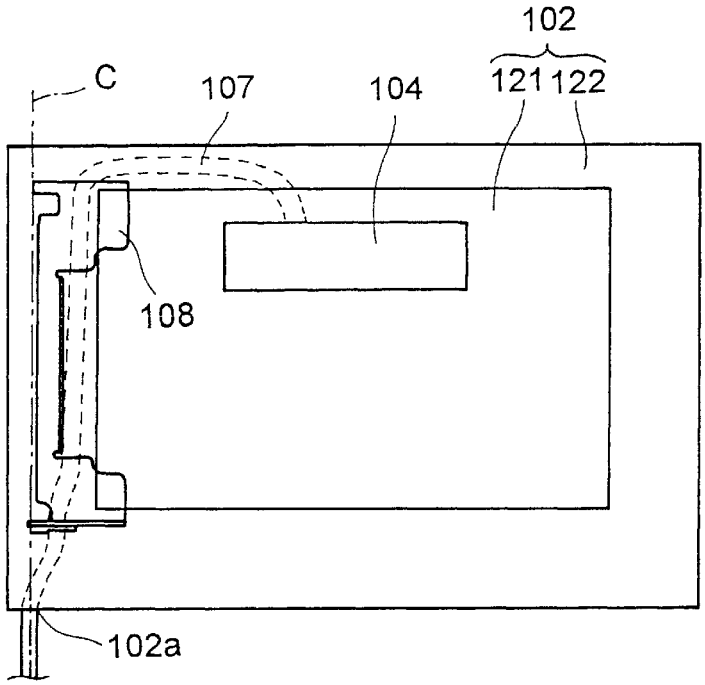
FIG. 12 is a diagram schematically illustrating the construction of the door of the cooking apparatus of the fifth embodiment as seen from the front.

In this cooking apparatus constructed as described above, leads 107 from the electronic components 104 are laid in the following manner. FIG. 12 is a diagram schematically illustrating the construction of the door 102 as seen from the front. The leads 107, starting from the electric components 104, run first inside the door 102 so as to reach the bottom of the door 102, with parts of the leads 107 fixed to the door screen 121 or to a door frame 122 on the way.

In the bottom face of the door frame 122, a second opening 102*a* is formed that has its center on the rotation axis C of the door 102. Through this second opening 102*a*, the leads 107 leaves the door 102. Here, below a door hinge 108 provided inside the door 102, a sufficient space is secured to accommodate the leads 107. The layout of the leads 107 inside the door 102 is not limited to that specifically shown in the figure, but may be otherwise as long as the leads 107 are so laid as to run through the second opening 102*a*.

Figure 13:
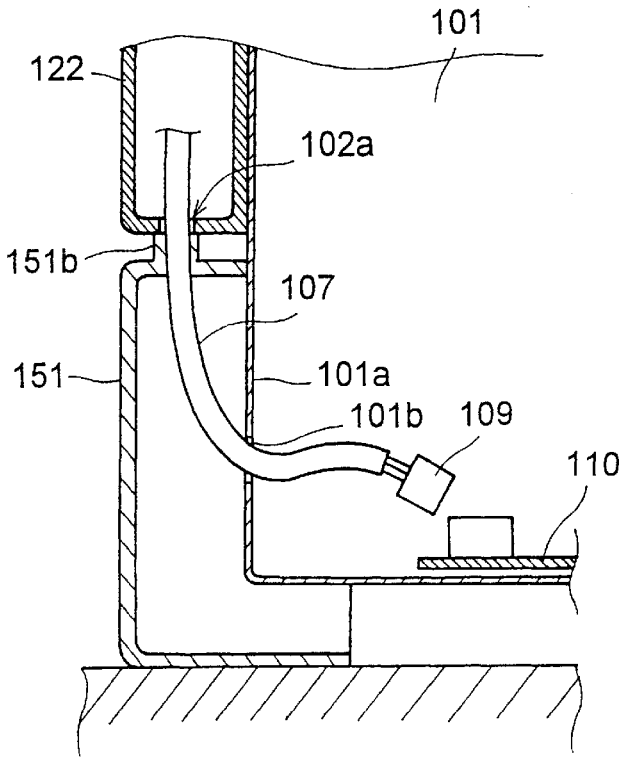
FIG. 13 is a vertical sectional view taken along broken line D shown in FIG. 10.

The leads 107 that have left the door 102 in this way then run inside the first foot portion 151 of the support member 105 shown in FIG. 10. Specifically, as shown in FIG. 13, which is a vertical sectional view taken along broken line D shown in FIG. 10, the leads 107, after passing through the second opening 102*a* of the door 102 then pass through the first opening 151*c* (see FIG. 11A) formed through the sleeve 151*b* of the first foot portion 151 provided right below.

Here, the second opening 102*a* of the door 102 and the first opening 151*c* (see FIG. 11A) of the sleeve 151*b* both have their centers on the rotation axis C (see FIGS. 11A and 12), and therefore these two openings communicate with each other. Moreover, the upper end of the sleeve 151*b* is kept in contact with the bottom face of the door 102. The sleeve 151*b* may be fitted into the door 102.

The first foot portion 151 is open at its back, and is, at its back, kept in contact with the front face 101*a* of the body 101. Thus, the leads 107 run inside the first foot portion 151, then pass through a third opening 101*b* formed in the front face 101*a* of the body 101, and then reach into the body 101. The leads 107 have a plug 109 fitted at the other end so as to be connected to a power supply portion 110 provided inside the body 101.

As described above, in the cooking apparatus of this embodiment, the first foot portion 151 of the support member 105 covers a lower portion of the front face 101*a* of the body 101, and the first foot portion 151 is so formed as to communicate with the inside of the door 102 and with the inside of the body 101 in order to permit the leads 107 to be laid through these members. In addition, the leads 107 are introduced into the first foot portion 151 through the sleeve 151*b*. Thus, no part of the leads 107 is exposed.

Moreover, the first opening 151*c* (see FIG. 11A) formed together with the sleeve 151*b* in the first foot portion 151 and the second opening 102*a* formed in the door 102 both have their centers on the rotation axis C (see FIG. 11A and 12), and therefore, even when the door 2 is opened or closed, the first and second openings 102*a* and 151*c* remain in position in a horizontal plane. This prevents the leads 107 from being bent every time the door 102 is opened or closed, and thus prevent damage to the leads 107.

Figure 14:
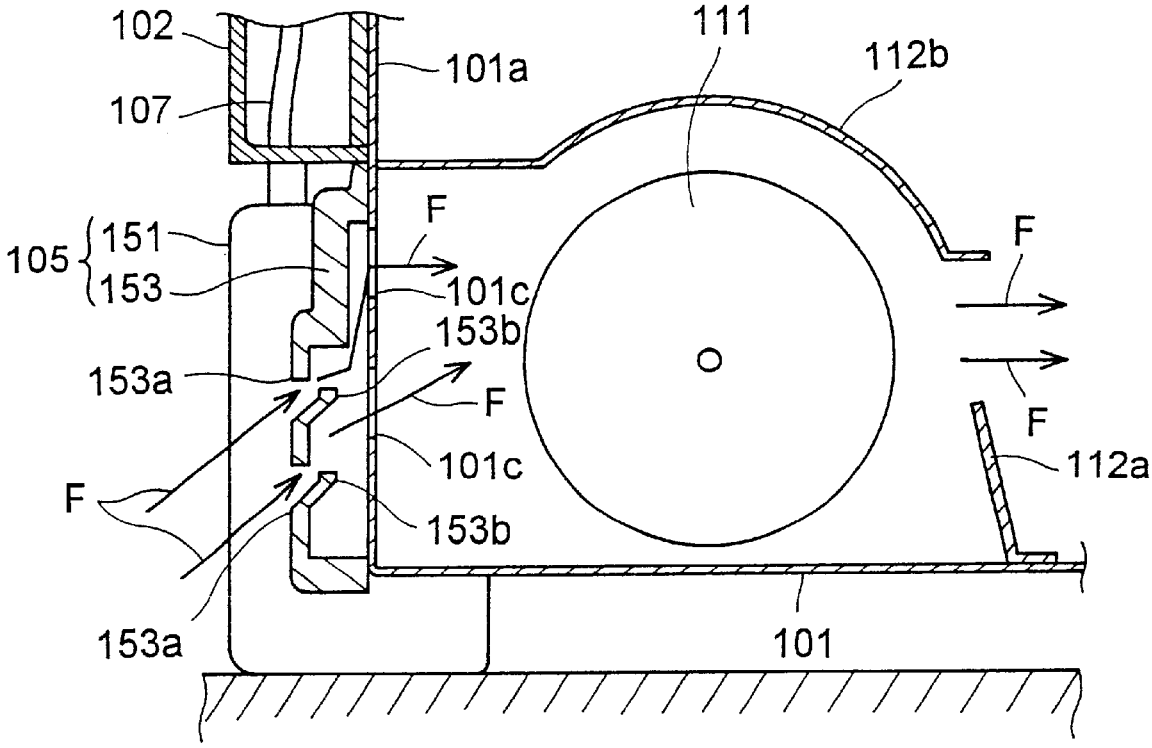
FIG. 14 is a vertical sectional view taken along broken line E shown in FIG. 10.
Figure 15:
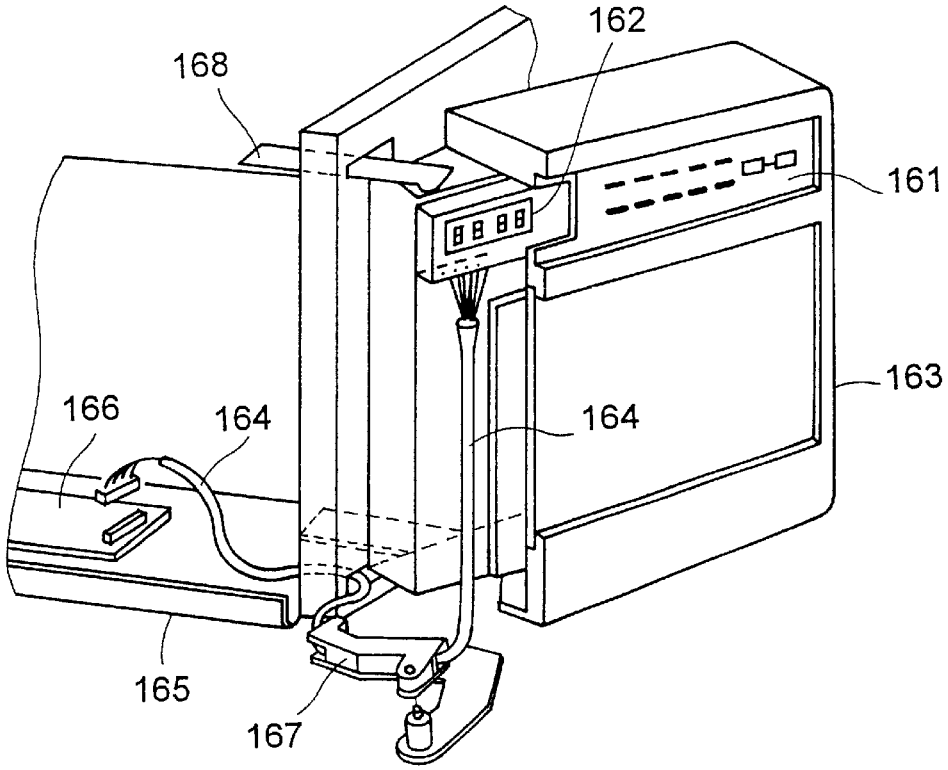
FIG.15 PRIOR ART
FIG. 15 is a diagram schematically showing an example of a conventional cooking apparatus.
Figure 16:
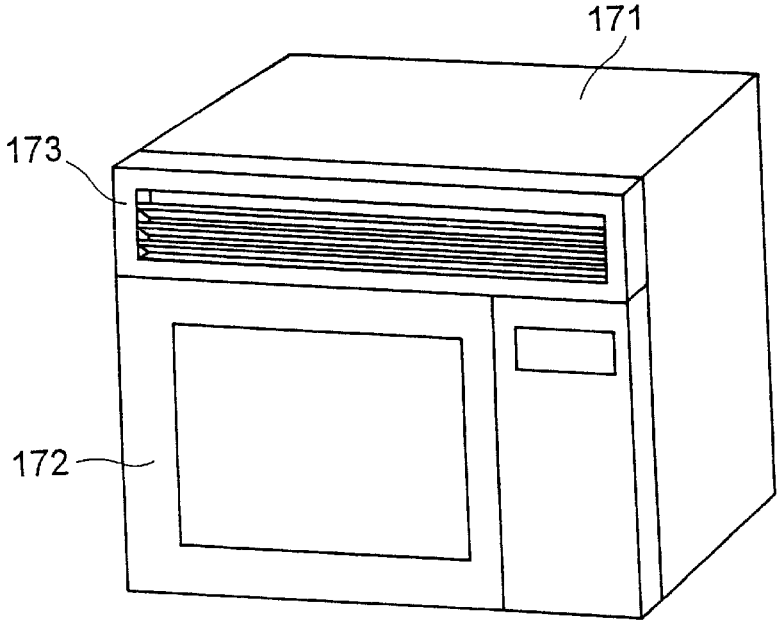
FIG.16 PRIOR ART
FIG. 16 is a perspective external view showing another example of a conventional cooking apparatus.

Next, the ventilation mechanism of this cooking apparatus will be described. FIG. 14 is a vertical sectional view taken along broken line E shown in FIG. 10 described previously. As shown in this figure, the support member 105 fitted to a lower portion of the front face 101*a* of the body 101 is, along the front cover portion 153 thereof, kept in contact with the front face 107*a*. As described previously, this front cover portion 153 has communicating openings 153*a* formed therein, and in addition has louver boards 153*b* provided so as to extend inward and obliquely upward from the lower edges of the individual communicating openings 153*a*.

Moreover, in a portion of the front face 101*a* of the body 101 that is covered with the front cover portion 153, vents 101*c* are formed. Inside the body 101, below the heating chamber (not shown), a cross-flow fan 111 is provided so as to face the vents 101*c*.

As soon as heating operation is started in the heating chamber, the cross-flow fan 111 is activated, so that air is introduced into the body 101 through the communicating openings 153*a* of the front cover portion 153 and through the vents 101*c* of the body 101 (in the figure, arrow F indicates the flow of air). This air flow F is then directed through air-flow ducts 112*a* and 112*b* toward the back of the body 101.

Behind the cross-flow fan 111 and the air ducts 112*a* and 112*b*, between the heating chamber and a bottom plate inside the body 101, a high-frequency generator (not shown) is provided that includes a magnetron and components for supply power thereto, such as a high-voltage transformer and a high-voltage capacitor. Thus, the high-frequency generator is cooled by the air flow F.

As described above, in the cooking apparatus of this embodiment, vents 101*c* are provided in a lower portion of the front face 101*a* of the body 101 that is covered with the front cover portion 153 of the support member 105, and a ventilating means is provided in the front cover portion 153. This helps make the vents 101*c* inconspicuous and thereby make the appearance of the cooking apparatus acceptable.

Moreover, providing the vents 101*c* in a lower portion of the front face 101*a* of the body 101 helps minimize the length of the air-flow path from the outside to the high-frequency generator (not shown) provided between the heating chamber (not shown) and the bottom plate inside the body 101. This ensures efficient cooling of the high-frequency generator.

In the cooking apparatus of this embodiment, the support member 105 is given functions of protecting the leads 107 and of covering the vents 101*c* to keep acceptable appearance. However, the support member 105 may be given only one of these functions. Specifically, the support member 105 may be either so configured that only the first opening 151*c*, together with the sleeve 151*b*, is formed in the first foot portion 151 thereof, or so configured that only the communicating openings 153*a* are formed in the front cover portion 153 thereof.

Although all the embodiments described hereinbefore deal with microwave ovens, the present invention may be applied to cooking apparatuses of other types.

As described above, according to the present invention, a cooking apparatus in which an operation portion that permits setting of heating conditions through operation of operation keys and a display panel that permits display of the heating conditions thus set are provided inside a door for opening and closing a heating chamber is constructed in the following manner. The operation keys, a display window through which to view the display panel, and a peep window through which to look into the heating chamber are formed in a door sheet. The door sheet is then laid over a door screen by being bonded thereto. The door screen is then fitted in a door frame that constitutes the outer frame of the door for opening and closing the heating chamber. This construction, as compared with conventional constructions in which those members are separately produced and then assembled into the door, requires less components and thus helps simplify the construction and reduce the cost of the cooking apparatus.

Moreover, a cylindrical sleeve that projects from inside the door toward the heating chamber and that rotates about the rotation axis of the door as the door is opened and closed is provided, and the leads that connect the operation portion and the display panel provided inside the door to a power source portion provided inside the body are laid through this sleeve. This prevents the leads from being exposed when the door is opened and closed, and thereby makes the appearance of the cooking apparatus acceptable, making the product attractive.

Moreover, in a cooking apparatus according to the invention, a support member is given functions of protecting leads and of making vents inconspicuous to keep acceptable appearance. This eliminates the need to produce a lead cover, a louver, and the like separately and then incorporate them, and thus helps simplify the construction and reduce the cost of the cooking apparatus.

In particular in cases where the leads are protected by the support member, even if a first opening formed in the support member is away from a second opening formed in the door, a cylindrical portion is formed around the first opening and the leads are laid therethrough. This helps securely prevent exposure of the leads.

Moreover, the first opening formed in the support member and the second opening formed in the door, through which the leads are laid, are located on the rotation axis of the door.

Thus, the leads are not bent as the door is opened or closed. This helps prevent damage to the leads, such as broken wires, and thereby realize a safe, high-quality cooking apparatus.

What is claimed is:

1. A cooking apparatus comprising:

a body having a heating chamber in which to put an article to be heated;

a door for opening and closing an opening of the heating chamber;

an operation portion, provided on the door, that permits control of cooking operation;

a display panel, provided on the door, for displaying information;

a door screen fitted in a front face of the door and formed of a transparent member; and a door sheet laid over the door screen by being bonded thereto, wherein in the door sheet are formed operation keys that permits entry of heating conditions into the operation portion, a transparent portion that serves as a display window through which to view the display panel, and a transparent portion that serves as a peep window through which to look into the heating chamber.

2. A cooking apparatus as claimed in claim 1, wherein the door screen is fitted in an outer frame of the door.

3. A cooking apparatus as claimed in claim 2, wherein the operation portion comprises:

ribs provided one behind each of the operation keys so as to project inward from a back face of the door screen; and tactile switches operated to make or break contact through the ribs individually as the operation keys are operated.

4. A cooking apparatus as claimed in claim 3, further comprising:

a circuit board placed behind and connected to the operation portion and the display panel; and a metal cover enclosing the display panel, the tactile switches, and the circuit board.

5. A cooking apparatus as claimed in claim 4, wherein, between the door screen and the circuit board, a shock absorbing member is laid for damping a mechanical shock that accompanies opening or closing of the door.

6. A cooking apparatus as claimed in claim 2, wherein the operation portion comprises a printed electrode assembly comprising:

an electrode sheet having a back surface thereof coated with a conductive thin film;

a pattern sheet having switch contacts arranged on a front surface thereof one pair for each of the operation keys; and a spacer made of an insulating material and laid between the electrode sheet and the pattern sheet so as to avoid the switch contacts, wherein, as one of the operation keys is pressed, the electrode sheet is partially deformed so that the conducting thin film makes contact with the corresponding pair of switch contacts.

7. A cooking apparatus as claimed in claim 6, wherein the printed electrode assembly is sandwiched between the door sheet and the door screen.

8. A cooking apparatus as claimed in claim 7, further comprising;

a circuit board placed behind and connected to the operation portion and the display panel; and a metal cover enclosing the display panel, the printed electrode assembly, and the circuit board.

9. A cooking apparatus as claimed in claim 8, wherein, between the door screen and the circuit board, a shock absorbing member is laid for damping a mechanical shock that accompanies opening or closing of the door.

10. A cooking apparatus as claimed in claim 1, further comprising:

a power supply portion provided inside the body;

leads for connecting the operation portion and the display panel to the power supply portion; and a cylindrical sleeve provided so as to project from a heating-chamber-side face of the door and rotate as the door is opened and closed, the sleeve having the leads laid therethrough, wherein a tip portion of the sleeve moves inside an opening formed near one edge of the front face of the door.

11. A cooking apparatus as claimed in claim 10, wherein the sleeve is provided below an upper hinge or a lower hinge on which the door is pivoted.

12. A cooking apparatus as claimed in claim 1, wherein a support member is provided at a bottom of the body so as to cover a bottom portion of the body, and the leads that connect the operation portion and the display panel to the power supply portion provided inside the body are so laid as to run first inside the door and then on a back side of the support member.

* * * * *